United States Patent [19]

Youd

[11] 3,981,169

[45] Sept. 21, 1976

[54] KEY HOLDING APPARATUS

[76] Inventor: James D. Youd, 35 Villa Drive, Foxboro, Mass. 02035

[22] Filed: June 6, 1975

[21] Appl. No.: 584,694

[52] U.S. Cl. ..... 70/456 R
[51] Int. Cl.[2] ..... A47G 29/10
[58] Field of Search ..... 70/456 R–459; 150/40; 24/31 C

[56] References Cited

UNITED STATES PATENTS

| | | | |
|---|---|---|---|
| 1,800,064 | 4/1931 | Getts | 70/456 R |
| 1,948,358 | 2/1934 | Reil | 70/456 R |

*Primary Examiner*—Robert L. Wolfe
*Attorney, Agent, or Firm*—John A. Haug

[57] ABSTRACT

A case for holding keys is shown comprising a flat, round base member having a plurality of key receiving stations spaced around the member. The stations are formed with longitudinal axes which are generally radially extending in several embodiments while in another embodiment they extend along chords of the circular base member. A cover with a key access slot formed therein is disposed on the base member and is rotatable thereon so that the slot can be brought into alignment with any selected station. A double sided key case is also shown in which stations are formed in both the top and bottom of the case. Top and bottom covers in this embodiment are each provided with a key access slot. A key mounting device is provided for each station and is disposed on the base member adjacent the outer periphery thereof. The key mounting devices are in the form of pivotable, lockable hooks or radially movable elongated lockable hooks.

13 Claims, 12 Drawing Figures

KEY HOLDING APPARATUS

This invention relates to key holders and more particularly to apparatus for holding a plurality of keys and for providing access to a group of keys only one at a time.

Although there are many types of key holders available in the marketplace each has limitations in its use, suitability and appeal. There is always a need for a key case which overcomes shortcomings of the prior art. Some problems not satisfactorily solved in the prior art include the tendency for keys to become entangled in a holder when a plurality of them are mounted therein, and the fact that the size and configuration of the holder has not been optimized, that is, either the holder has been unduly bulky so that it forms a bulge when placed in the pocket of an article of apparel or it has been so small that it is difficult to find, particularly in the dark when disposed in a typical handbag. Additionally, many key holders are lacking in esthetic appeal for individuals who desire to have something distinctive as well as attractive.

It is therefore an object of the invention to provide a key holder capable of mounting a plurality of keys without danger of entanglement of the keys.

Another object of the invention is the provision of a keyholder which is of optimum size and configuration, one which is not bulky yet is readily distinguishable by touch to facilitate ready discrimination between it and other articles.

Yet another object of the invention is the provision of a keyholder which is inexpensive yet reliable and esthetically appealing.

Various additional objects and advantages of the present invention will become readily apparent from the detailed description and accompanying drawings.

Briefly the above objects are realized by providing a flat, round base member having a plurality of key receiving stations spaced around the member. The stations are formed with a longitudinal axis which in certain embodiments extends radially and in another embodiment extends along chords of the circular base member. A cover with a key access slot formed therein is disposed on one or both sides of the base member and is rotatable thereon so that the slot can be brought into alignment with any selected station. The keys are mounted in each station by means of lockable hooks which in one embodiment are pivotably mounted adjacent the outer periphery of the base and in a second embodiment are radially movable outwardly from the stations.

In the accompanying drawings in which several of the preferred embodiments of the invention are illustrated;

Figure 1:
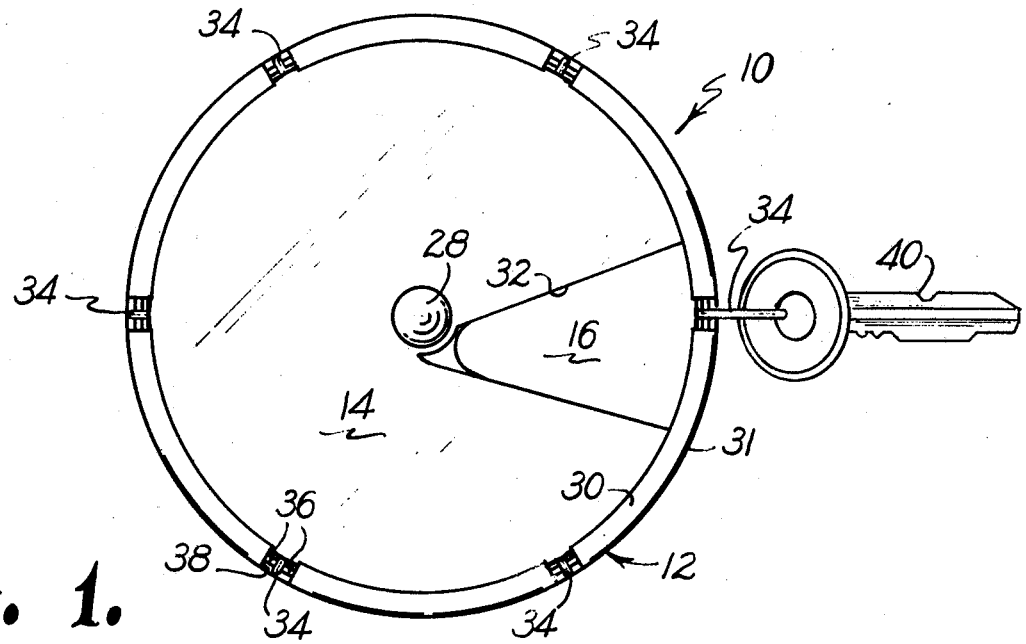
FIG. 1 is a top plan view of a keycase made in accordance with the invention showing a key extending from the keycase ready for use.

Dimensions of certain parts as shown in the drawing may have been modified or exaggerated for the purpose of clarity of illustration.

Figure 3:
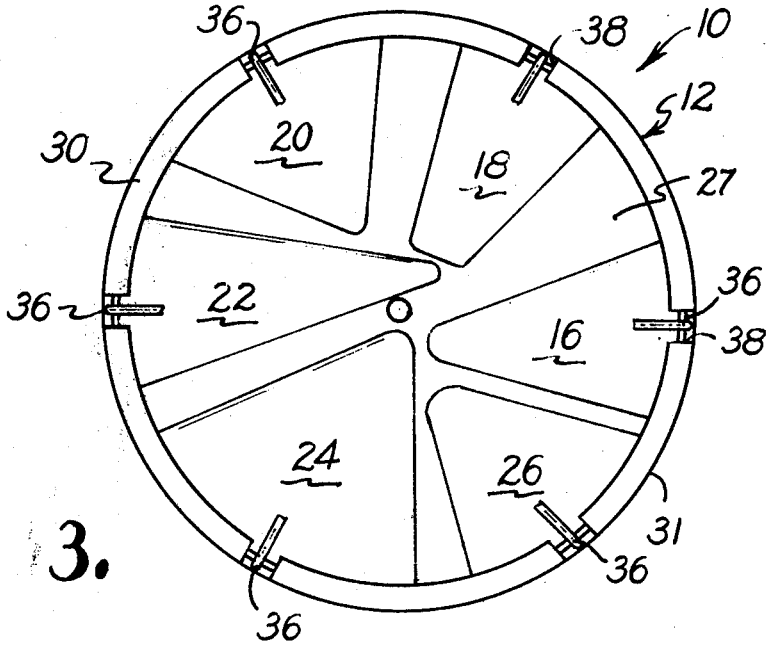
FIG. 3 is a view similar to FIG. 1 but with the rotatable cover removed and without keys showing key receiving recesses or stations in the base member.

Referring now to the drawings, numeral 10 indicates a keycase made in accordance with the invention comprising a flat, generally round base member 12 having a bottom 13 and a rotatable cover 14 disposed thereon. As seen in FIG. 3 a plurality of key receiving generally wedge shaped recesses or stations 16–26 are provided in the base member in any convenient manner, as by molding them in the base member. The cover 14 rests on land area 27 and is rotatably mounted thereon as by utilizing a centrally located pin 28. Base member 12 is provided with a lip 30 extending inwardly from side wall 31 to capture the outer peripheral portion of cover 14. Alternatively, if desired, a lip could be formed integrally with cover 14 to capture the outer peripheral portion of base member 12. If desired, cover 14 can be rotatably mounted using lip 30 without the necessity of center pin 28. Cover member 14 is provided with a key access slot 32 so arranged that upon rotation of cover 14 the slot can be aligned with any selected key receiving station 16–26.

A plurality of lockable hooks 34 are pivotably mounted adjacent the outer periphery of the base on pins 36 arranged in slots formed in base 12 so that a key 40 mounted on a hook 34 can be pivoted out of a selected recess 16–26 when slot 32 is aligned with the recess.

It should be noted that recesses 16–26 may be of different sizes to accommodate different sized keys and that the radial depth or longitudinal axis of certain of the recesses, for example recess 22, that is the length extending from the innermost to the outermost portions of the recess, can exceed the radius of the base member thereby enabling the mounting of longer keys without increasing the overall dimensions of the keycase.

Figure 2:
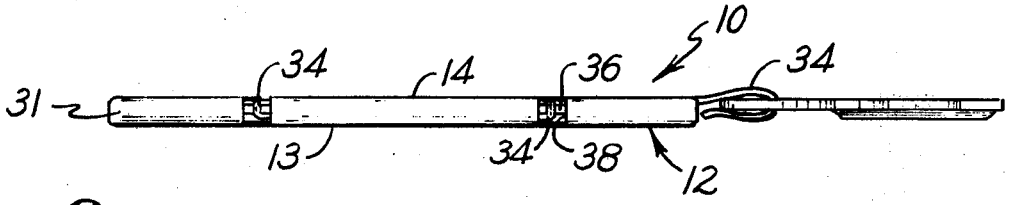
FIG. 2 is a front elevational view of the FIG. 1 keycase.
Figure 4:
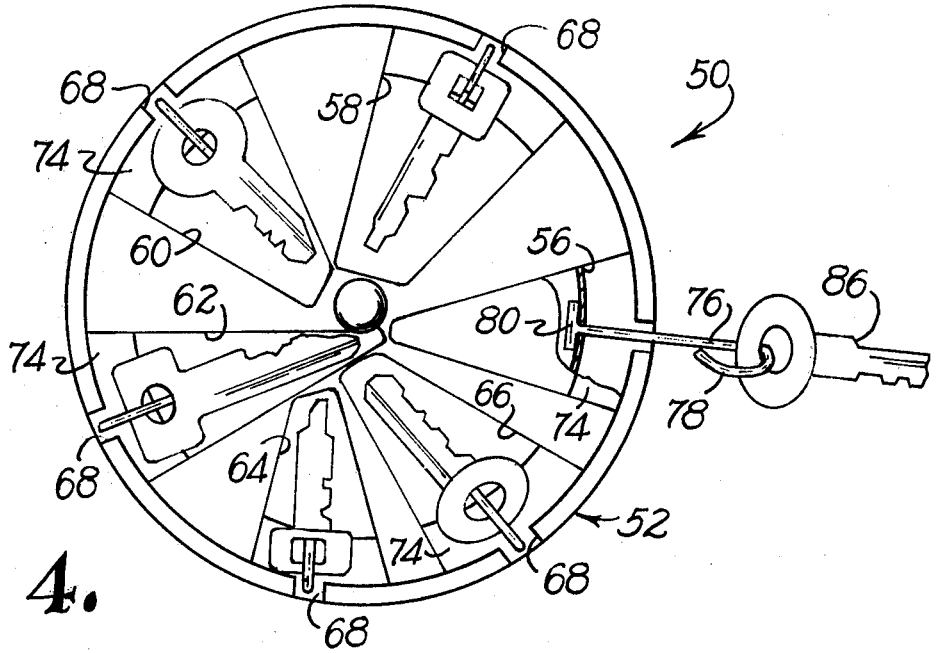
FIG. 4 is a top plan view of a second embodiment of the invention with the cover removed and with portions broken away for purposes of illustration.
Figure 5:
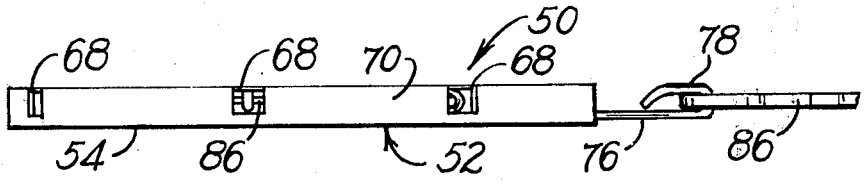
FIG. 5 is a front elevational view of the FIG. 4 embodiment.
Figure 6:
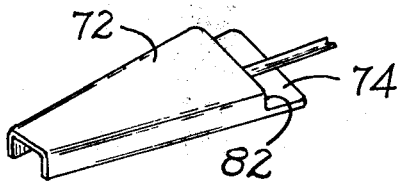
FIG. 6 is a perspective view of a retainer plate.

A second embodiment 50 is shown in FIGS. 4–6 which comprises a base member 52 similar to base member 12 of FIGS. 1–3. Base member 52 is provided with a bottom 54 and a cover (not shown) similar to cover 14 in FIG. 1.

Recessed key receiving stations 56–66 are formed in base member 52 and a slot 68 is provided in side wall 70 in alignment with each recessed key receiving station. Also mounted in each key receiving station is a retainer plate 72 of a configuration matching the respective recess and having a step portion 74. An elongated key holding member 76 having a lockable hook 78 either integral with or attached to one end and tab portion 80 at the opposite end extends through an aperture in wall 82 of plate 72.

Figure 7:
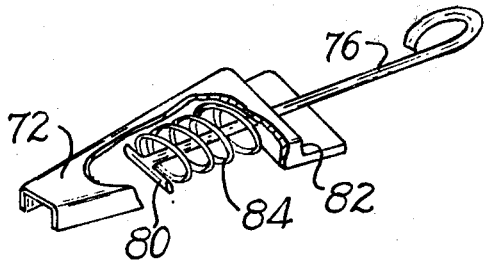
FIG. 7 is a perspective view, partly broken away, of a modification of the retainer plate arrangement shown in FIG. 6.

The cover is rotated until the access slot is aligned with the key which is desired for use, the key is flipped out of the recess and member 76 is drawn radially outwardly to permit ready handling of the key. Outward movement of elongated member 76 is limited by the engagement of tab 80 with wall portion 82 of retainer plate 72. If desired a return spring 84 as seen in FIG. 7 can be interposed between wall portion 82 and tab 80 to provide automatic retraction of the key into the key receiving station.

Figure 8:
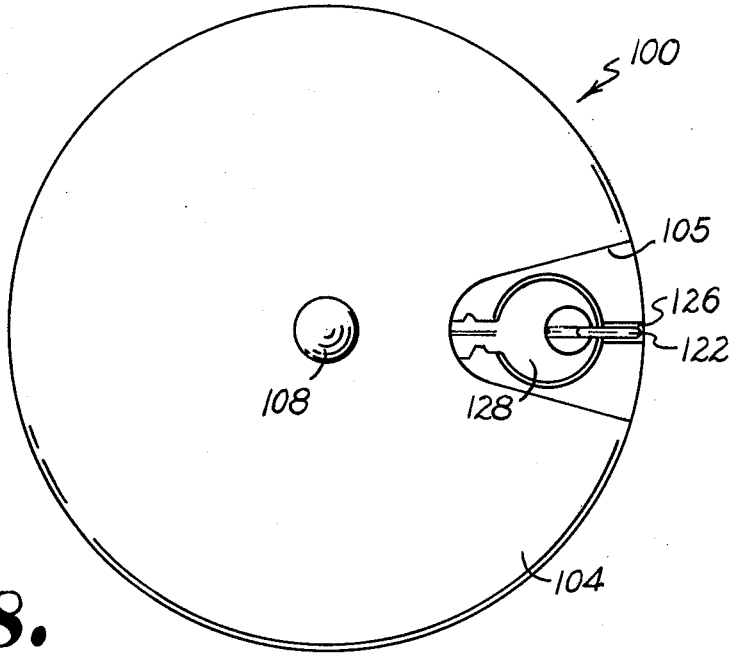
FIG. 8 is a top plan view of another embodiment of the invention.
Figure 9:
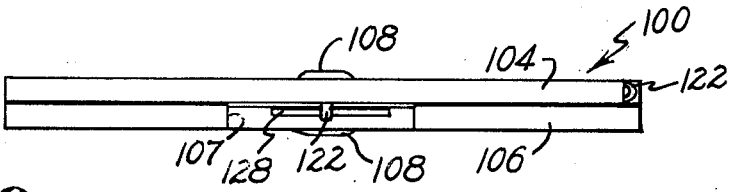
FIG. 9 is a front elevational view of the FIG. 8 embodiment.
Figure 10:
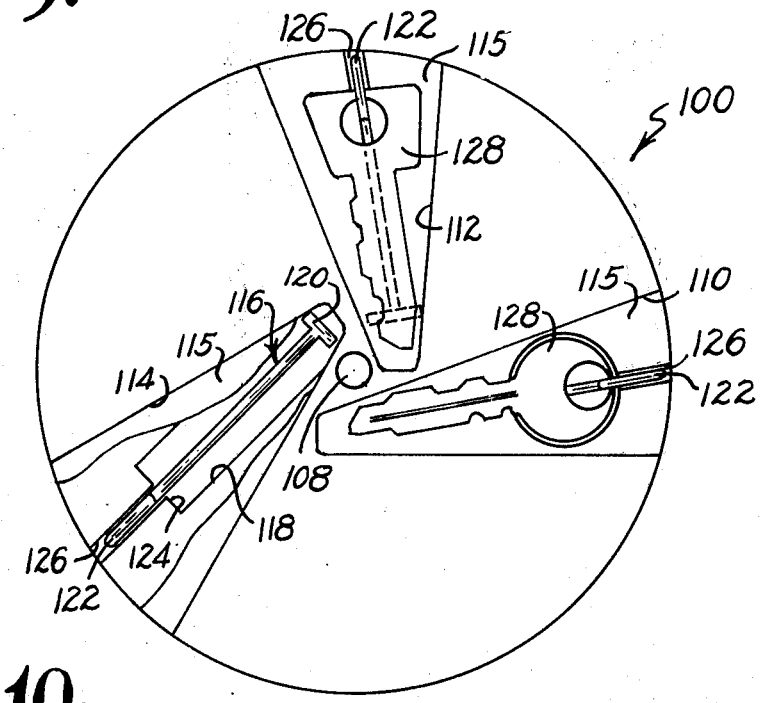
FIG. 10 is a view similar to FIG. 8 but with the top cover removed and with a portion broken away to show key retaining means.

FIGS. 8–10 show a double sided keycase 100 similar to that shown in previous Figures but provided with key receiving recessed stations on both sides of a base member 102. Keycase 100 comprises top and bottom covers 104, 106 with a respective key access slot 105, 107 rotatably mounted on centrally located pin 108. As seen in FIG. 10 three stations 110, 112 and 114 are shown although the particular number of stations provided is a matter of choice. It will be noted that the three stations shown all have a longitudinal axis which exceeds the radius of the base member to accommodate long keys. Key retaining means is mounted at each station in a manner similar to that shown in the FIG. 4–6 embodiment. An elongated key holding member 116 is disposed in a channel 118 located in the base member beneath floor 115 of a respective station and is adapted to move generally radially inwardly and outwardly. Key holding member 116 is provided with tab 120 at one end and a lockable hook 122 either integral with or attached to its opposite end. Tab 120 limits outward movement of member 116 by engagement with wall 124 of channel 118. Floor 115 of each station is provided with a cut out portion 126 to permit elongated key holding member to move radially inwardly within the cover member.

In order to use key case 100, cover 104 or 106 is rotated until the desired key is aligned with the key access slot 105 or 107. The selected key 128 and hook 122 are grasped and pulled outwardly until the innermost portion of the key is clear of the cover and then the key is flipped out of the recess and is ready for use. Slot 105 is shown having a radial depth which is shorter than slot 32 of key case 10 of FIGS. 1–3 since the key holder can be moved radially outwardly before the key is pivoted out of the recess.

Figure 11:
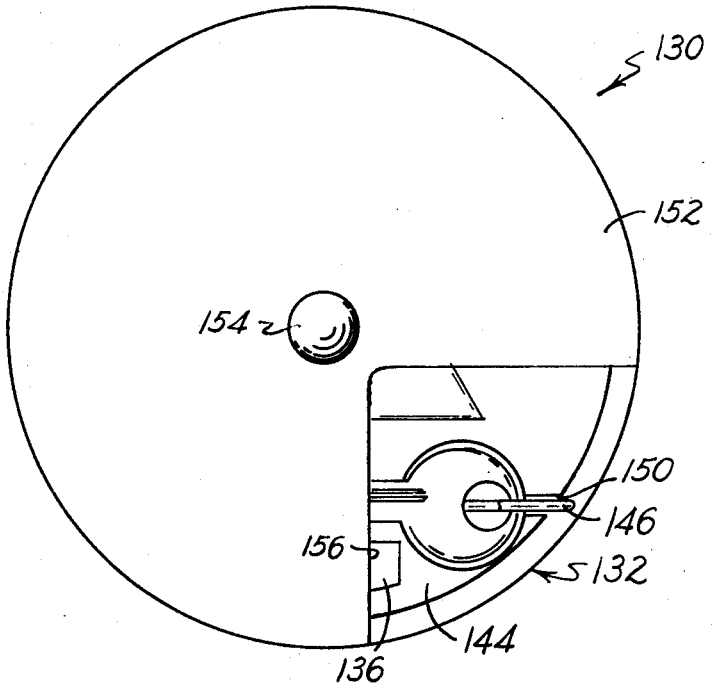
FIG. 11 is a top plan view of yet another embodiment of the invention.
Figure 12:
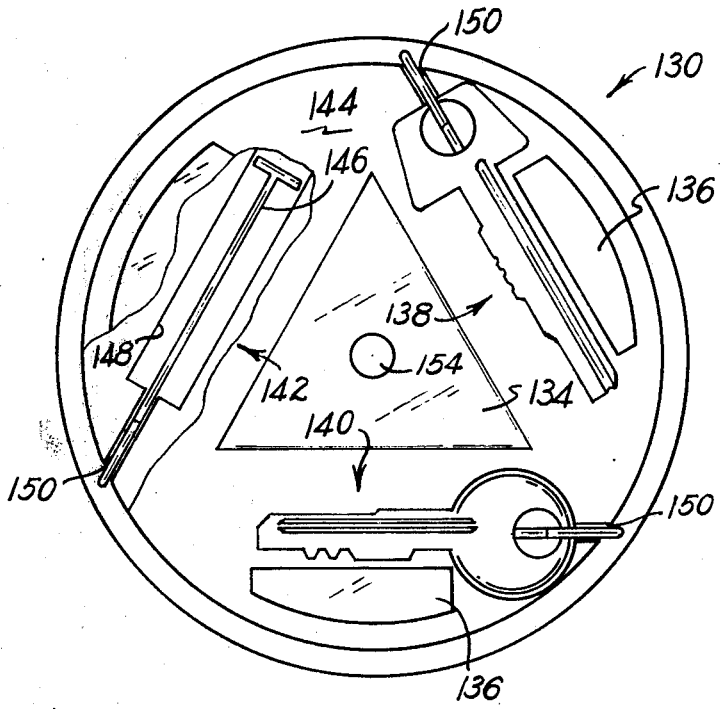
FIG. 12 is a view similar to FIG. 11 but with the cover removed and with a portion broken away to show key retaining means.

Another key case 130 is depicted in FIGS. 11 and 12 which differs from the previous embodiments primarily in that the key receiving stations have a longitudinal axis which extends along a chord of the round base member rather than extending generally radially. Base member 132 is provided with raised land portions 134, 136 defining key receiving pockets 138, 140, 142 therebetween. Base member 132 is provided with a floor 144 which is broken away in part to show elongated key holder 146 in channel 148 of base member 132. Key holder 146 is essentially identical with that shown in FIGS. 8–10 to which reference may be had for a more detailed description. Floor 144 is cut out at 150 to permit movement of the key holder within the outer periphery of the base member 132. Cover 152 is rotatably mounted at pin 154 on base member 132 and is provided with key access slot 156. Thus a user merely grasps the selected key and holder 146, pulls it outwardly until the key clears the cover and pivots the key out of the station ready for use.

Thus it will be seen that a key case has been described which achieves the objects of the invention, is economical to produce yet is efficient. The key case allows the use of one key at a time without the danger of the keys becoming entangled. Further the key case is of a configuration which is easily identified by touch even when in the midst of many other objects as when disposed in a lady's handbag, without being bulky.

Although the invention has been described with respect to certain specific preferred embodiments thereof, many other variations and modifications will immediately become apparent to those skilled in the art. It is therefore the intention that the appended claims be interpreted as broadly as possible in view of the prior art to include all such variations and modifications.

I claim:

1. Key case apparatus comprising a. a generally flat circular base member, a plurality of key recesses formed in the base member and lying in a plane, b. a cover rotatably mounted on the base member, a key access slot formed in the cover adapted to provide access to a selected key receiving recess upon alignment of the slot with the selected recess, and c. key mounting means for each key receiving recess provided on the base member, the key mounting means mounting the keys so that a selected key can be moved out of the plane of the key receiving recess when the key access slot is in alignment with the selected key receiving recess.

2. Key case apparatus comprising a. a generally flat circular base member, a plurality of key recesses formed in the base member, the base member formed with a top surface, the key receiving recesses are in communication with the top surface and are radially extending generally wedge shaped as seen in top plan view, b. a cover rotatably mounted on the base member, aa key access slot formed in the cover adapted to provide access to a selected key receiving recess upon alignment of the slot with the selected recess, and c. key mounting means for each key receiving recess provided on the base member, the key mounting means mounting the keys so that a selected key can be moved out of the key receiving recess when the key access slot is in alignment with the selected key receiving recess.

3. Key case apparatus according to claim 2 in which a selected number of the recesses, but fewer than all of the plurality of recesses, have a length extending from the innermost portion of the recess to the outermost portion of the recess which exceeds the radius of the circular base member.

4. Key case apparatus according to claim 1 in which the base member is formed with a side wall having a slot in alignment and communication with each key receiving recess.

5. Key case apparatus comprising a. a generally flat circular base member, a plurality of key recesses formed in the base member, the base member formed with a side wall having a slot in alignment and communication with each key receiving recess, the side wall having an integrally attached, inwardly extending lip, b. a cover rotatably mounted on the base member, a key access slot formed in the cover adapted to provide access to a selected key receiving recess upon alignment of the slot with the selected recess, the cover having an outer peripheral portion received beneath the lip, and c. key mounting means for each key receiving recess provided on the base member, the key mounting means mounting the keys so that a selected key can be moved out of the key receiving recess when the key access slot is in alignment with the selected key receiving recess.

6. Key case apparatus according to claim 4 in which the key mounting means includes a lockable hook pivotably mounted at each slot.

7. Key case apparatus comprising a. a generally flat circular base member, a plurality of key recesses formed in the base member, b. a cover rotatably mounted on the base member, a key access slot formed in the cover adapted to provide access to a selected key receiving recess upon alignment of the slot with the selected recess, and c. key mounting means for each key receiving recess provided on the base, the key mounting means including an elongated member having an inner and an outer end for each key receiving recess, the elongated member radially movable through the slot aligned with the respective recess, each elongated member provided with a key mounting hook at the outer end thereof, the key mounting means mounting the keys so that a selected key can be moved out of the key receiving recess when the key access slot is in alignment with the selected key receiving recess.

8. Key case apparatus according to claim 7 in which a retainer plate is disposed in each key receiving recess and the elongated member extends through an aperture in the retainer plate.

9. Key case apparatus according to claim 8 in which the inner end of each elongated member is provided with a tab, and spring means is disposed on each elongated member between the tab and the retainer plate to facilitate return of a key to its respective key receiving recess.

10. Key case apparatus according to claim 1 in which the key recesses are formed with longitudinal axes which extend in the same direction as chords of the circular base member.

11. Key case apparatus according to claim 1 in which the base member is formed with a top and bottom surface, certain key receiving recesses are in communication with the top surface and other key receiving recesses are in communication with the bottom surface.

12. Key case apparatus according to claim 11 in which a top and a bottom cover, each provided with a key access slot are rotatably mounted on the base member.

13. Key case apparatus comprising a. a generally flat circular base member having a top surface and an outer peripheral portion, a plurality of key receiving recesses formed in the base member in communication with the top surface, each of the recesses having a bottom surface lying in a plane, b. a cover rotatably mounted on the top surface of the base member, a key access slot formed in the cover adapted to provide access to a selected key receiving recess upon alignment of the slot with the selected recess, and c. key mounting means for each key receiving recess disposed adjacent the outer peripheral portion of the base member, the key mounting means pivotably mounting the keys so that a selected key can be pivoted out of the plane of the key receiving recess when the key access slot is in alignment with the selected key receiving recess.

* * * * *